US006508294B1

(12) United States Patent
Wu

(10) Patent No.: US 6,508,294 B1
(45) Date of Patent: Jan. 21, 2003

(54) RAISING DEVICE FOR A VENETIAN BLIND

(75) Inventor: Tung-Yuan Wu, Tainan (TW)

(73) Assignee: Poly Vigor Enteprises Co., Ltd., Tainan (TW)

( * ) Notice: Subject to any disclaimer, the term of this patent is extended or adjusted under 35 U.S.C. 154(b) by 0 days.

(21) Appl. No.: 10/002,088

(22) Filed: Dec. 6, 2001

(51) Int. Cl.[7] ..... E06B 9/30
(52) U.S. Cl. ..... 160/170 R
(58) Field of Search ..... 160/170 R, 171 R, 160/173 R, 168.1 R, 319, 321, 84.01, 84.04, 84.05, 84.06

(56) References Cited

U.S. PATENT DOCUMENTS 5,092,382 A * 3/1992 Fluckiger ..... 160/170 R
5,799,715 A * 9/1998 Biro et al. ..... 160/170 R
5,996,667 A * 12/1999 Fun ..... 160/170 R X

* cited by examiner

*Primary Examiner*—David Purol
(74) *Attorney, Agent, or Firm*—Rosenberg, Klein & Lee

(57) ABSTRACT

A raising device for a Venetian blind has a lift cord, and two intermediate turning elements. The intermediate turning elements each has two pairs of opposing disks, which are connected to two ends of a central reel, and has cylindrical protrusions sticking out from the other sides. Radially spaced engaging bars are formed on the inner sides of each pair of the disks. The intermediate turning elements are turnably fitted to the stationary support from the cylindrical protrusions with the disks being upright. Strings are connected to the central reels from the upper ends, and a lowermost one of the slats of a blind from the lower ends. The lift cord has spaced beads secured thereto, and is passed over a left turning element, which has radial bars for the beads to separably engage, from an intermediate part with two parallel portions next to the intermediate part passing onto between the each pair of the disks of the intermediate turning elements such that the beads can separably engage the engaging bars. The lift cord is further hung on a right end element from two ends. Thus, the blind can be raised and lowered by pulling the end portions of the life cord to cause the intermediate turning elements to turn.

1 Claim, 5 Drawing Sheets

RAISING DEVICE FOR A VENETIAN BLIND

BACKGROUND OF THE INVENTION

The present invention relates to a raising device for a Venetian blind, and more particularly to one, which has relatively simple structure, and can be assembled with ease.

Referring to FIG. 6, a conventional raising device for a Venetian blind includes a stationary support element 10, two winding elements 30, a turning rod 40, a turning element 70, a lift cord 90, a lift cord lock 80, and a support 50 for turning element 70.

The stationary support element 10 is fixed to the upper side of a windows and has a receiving room defined by a top and two opposing walls, which each has a holding part 101 sticking inwardly of the supporting element at the bottom.

The winding elements 30 each has a main body 301, a reel 302, and a connecting string 303; the main body 301 has round holes 3011 at two ends thereof and slots 3012 at the bottom; the reel 302 has round rods sticking out from two ends to pass into a respective one of the round holes 3011 of the main body 301 such that the reel 302 can be turned in the main body 301; the reel 302 further has a hole 3023, a lengthwise formed polygonal hole 3021 communicating with the round holes 3011 of the main body 301, and round disks 3022 at two end portions; the connecting string 303 is passed through the hole 3023, and formed with knot at the upper end so as to be connected to the reel 302; the lower end of the connecting string 303 is passed through the slot 3012 of the main body 301, and connected to a lowermost one of the slats of the Venetian blind. The winding elements 30 are received in the room of the stationary support element 10, and supported by the holding parts 101 with a proper distance in between fixing elements 304 are connected to the holding parts 101 and the bottoms of the main bodies 301 with screws 305 so as to fix the main bodies 301 of the winding elements 30 in position.

The turning rod 40 also has a polygonal shape the same as the polygonal holes 3021, and is passed through the polygonal holes 3021 of the reels 302 such that the reels 302 can turn together with the turning rod 40.

The turning element 70 has two opposing round disks 703, and a cylindrical rod 701 having a lengthwise formed polygonal hole 702; one of the round disks 703 is formed with several radially arranged engaging ribs 704 on the inner side. The lift cord 90 includes a string and beads connected to the string with equal distance in between; the lift cord 90 is passed onto between the round disks 703 from a middle portion such that the beads thereof can engage the engaging ribs 704 to cause the turning element 70 to turn when the lift cord 90 is pulled down.

The support 50 of the turning element 70 includes a connecting protrusion 501, a covering protrusion 502, a round hole 505, a recess 506, and a pivotal rod 507 sticking out from the recess 506; the covering protrusion 502 has screw holes 503, and locating protrusions 504. The cylindrical rod 701 of the turning element 70 is passed through the round hole 505 of the support 50. The connecting protrusion 501 is closely fitted into one end of the stationary support element 10, and secured in position with the turning rod 40 passing into the polygonal hole 702 of the turning element 70. The support 30 further has a cover 60, which has a covering protrusion 601, a pivotal rod 605, through holes 602, hollows 603, a recess 606, and a pivotal rod 607 sticking out form the recess 606.

The lift cord lock 80 has a round hole 801, and a locking part 802 formed with a gap and is pivotably mounted around the pivotal rod 507 of the support 50 with one of the edges of the locking part 802 being confined in the recess 506.

The support cover 60 is secured to the support 50 with the covering protrusion 601 abutting the covering protrusion 502 to cover the turning element 70, and with the through holes 602 facing the screw holes 503; screws 604 is screwed into the holes 602 and 503 to join the support 50 and the support cover 60 together; the locating protrusions 504 and the hollows 603 can help the support cover 60 to be fitted onto the support 50 in a correct position quickly: the pivotal rod 605 of the support cover 60 passes into a round hole (not shown) at the other end of the turning element 70; the pivotal rod 607 passes into the round hole 801 of the lift cord lock 80 with the recess 606 confining the other edge of the locking part 802 such that the lock 80 can pivot on the pivotal rods 507 and 607 only within a certain range defined by the recesses 506 and 606; the front end portion of the lift cord 90 contacts the locking part 802 of the lift cord lock 80 after passing around the turning element 70.

Thus, the blind can be raised by means of pulling the lift cord 90 downwards; the beads of the lift cord 90 engage the engaging ribs 704 to turn the turning element 70 mid the turning rod 40, and the reels 302 will turn together to wind the connecting string 303 when the lift cord 90 is pulled down. The beads of the lift cord 90 will engage the locking part 802 of the lift cord lock 80 from the lower sides of the locking part 80 to prevent the turning element 70 from unwantedly turning when the user releases his hold of the lift cord 90 after the pulling action.

The blind can be lowered and raised easily with the raising device, however, as can be seen, the raising device consists of a lot of components, which make the structure relatively complicated and the assembly labor costing.

SUMMARY OF THE INVENTION

Therefore, it is a main object of the present invention to provide a hanging rod for a Venetian blind which has fewer parts such that the structure is simplified, and the assembly needs less labor.

The raising device for a Venetian blind in the present invention includes a stationary support, a first turning element, two intermediate turning elements, a third turning element and a lift cord.

The stationary support is fitted to an upper side of a window. The first turning element consists of two opposing disk portions, and two cylindrical protrusions each sticking out from one of the disk portions. One of the disk portions are provided with radially spaced engaging bars on an inner side. The first turning element is turnably fitted to the left end of the stationary support with the disk portions being horizontal.

The intermediate turning elements and the third turning element each consists of a central reel part, and two pair of opposing disks connected to two ends of the reel part; each pair of opposing disks are provided with radially spaced engaging bars on an inner side, and a cylindrical protrusion on an outer side. The intermediate turning elements are turnably fitted to the stationary support with the disks being positioned upright, and each is connected to the upper end of a string at the reel part; the strings are connected to a lowermost one of the slats of the blind. The third turning element is turnably fitted to the right end of stationary support with the disks thereof being upright.

The lift cord has beads connected thereto in a spaced manner, and is passed onto between each pair of opposing disks from the intermediate portions thereof with two end portions hanging on the third turning element.

Thus, the blind can be lowered and raised by pulling the hanging end portions of the lift cord; the movement of the cord along the stationary support caused by the pulling action makes the turning elements turn, of which the engaging bars are separably engaged with the beads.

BRIEF DESCRIPTION OF THE DRAWINGS

The present invention will be better understood by reference to the accompanying drawings, wherein.

DETAILED DESCRIPTION OF THE PREFERRED EMBODIMENT

Figure 1:
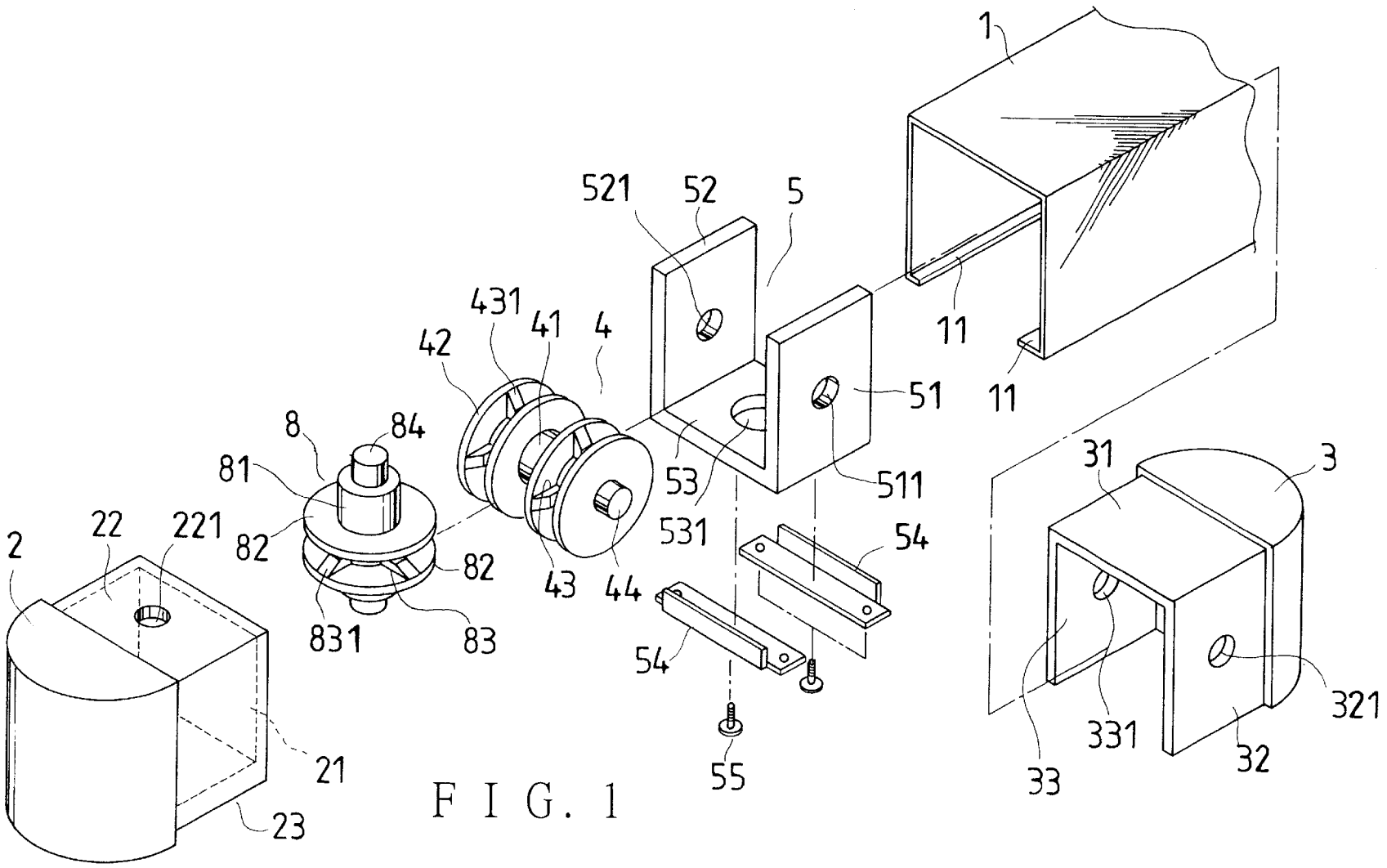
FIG. 1 is an exploded perspective view of the raising device for a Venetian blind according to the present invention.
Figure 2:
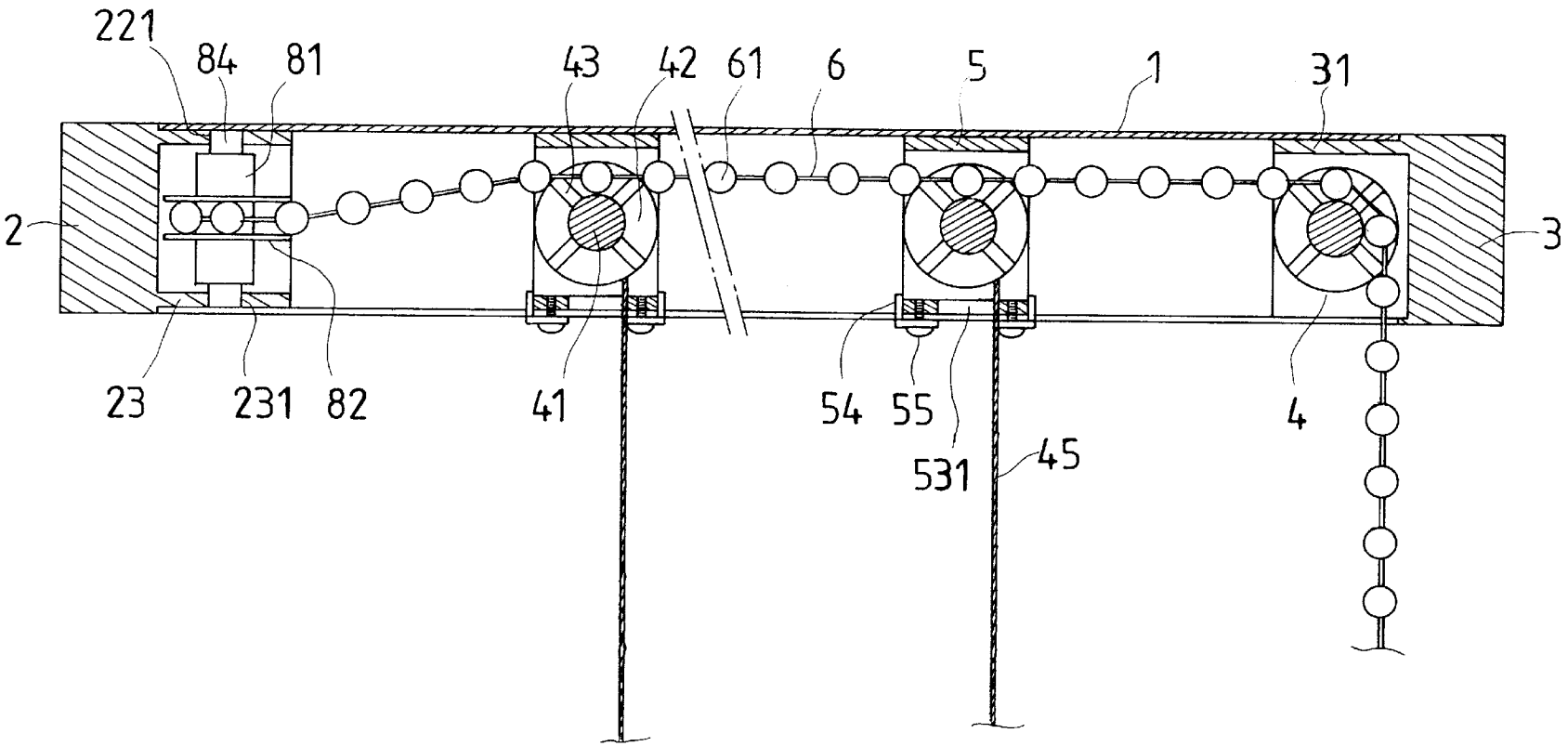
FIG. 2 is front plan view of the raising device for a Venetian blind according to the present invention.

Referring to FIGS. 1 and 2, a raising device for a Venetian blind according to the present invention includes a stationary support element 1, a first turning element 8, a left support 2, two intermediate winding members, which each consists of both an intermediate turning element 4 and an intermediate support 5, a third turning element (shown at the right end of FIG. 2), a right support 3 and a lift cord 6.

The stationary support element 1 is fixed to the upper side of a window, and has a receiving room defined by a top and two opposing walls, which each has a holding part 11 sticking inwardly of the support element 1 at the bottom.

Figure 3:
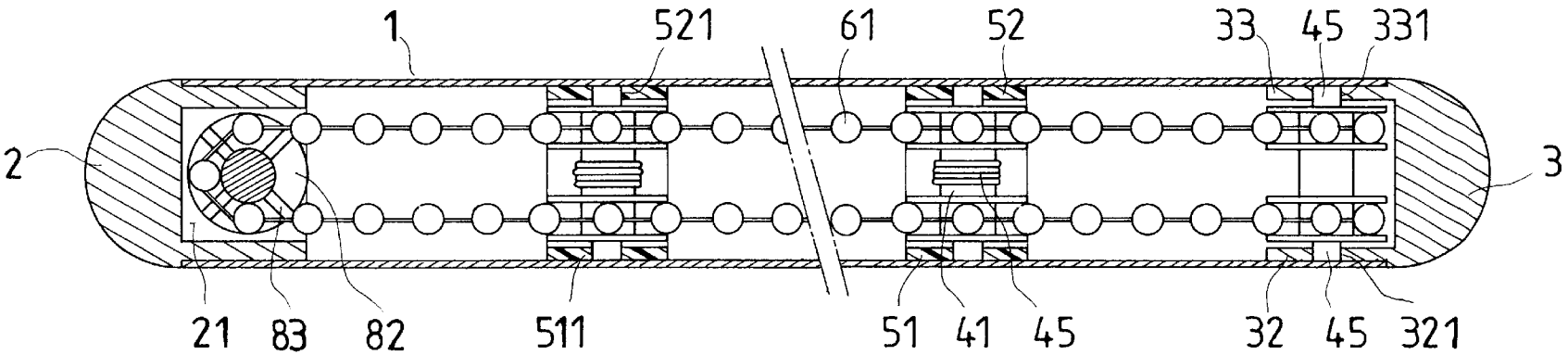
FIG. 3 is a top plan view of the raising device for a Venetian blind according to the present invention.
Figure 4:
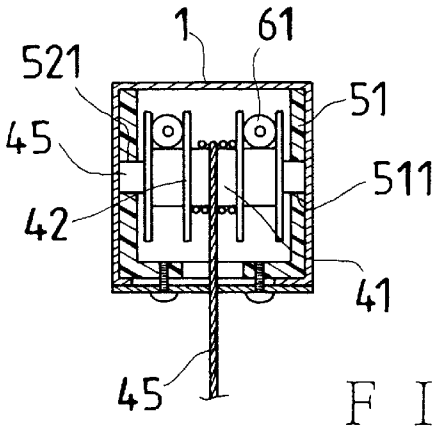
FIG. 4 is a side view of the intermediate turning element of the raising device of the present invention.
Figure 5:
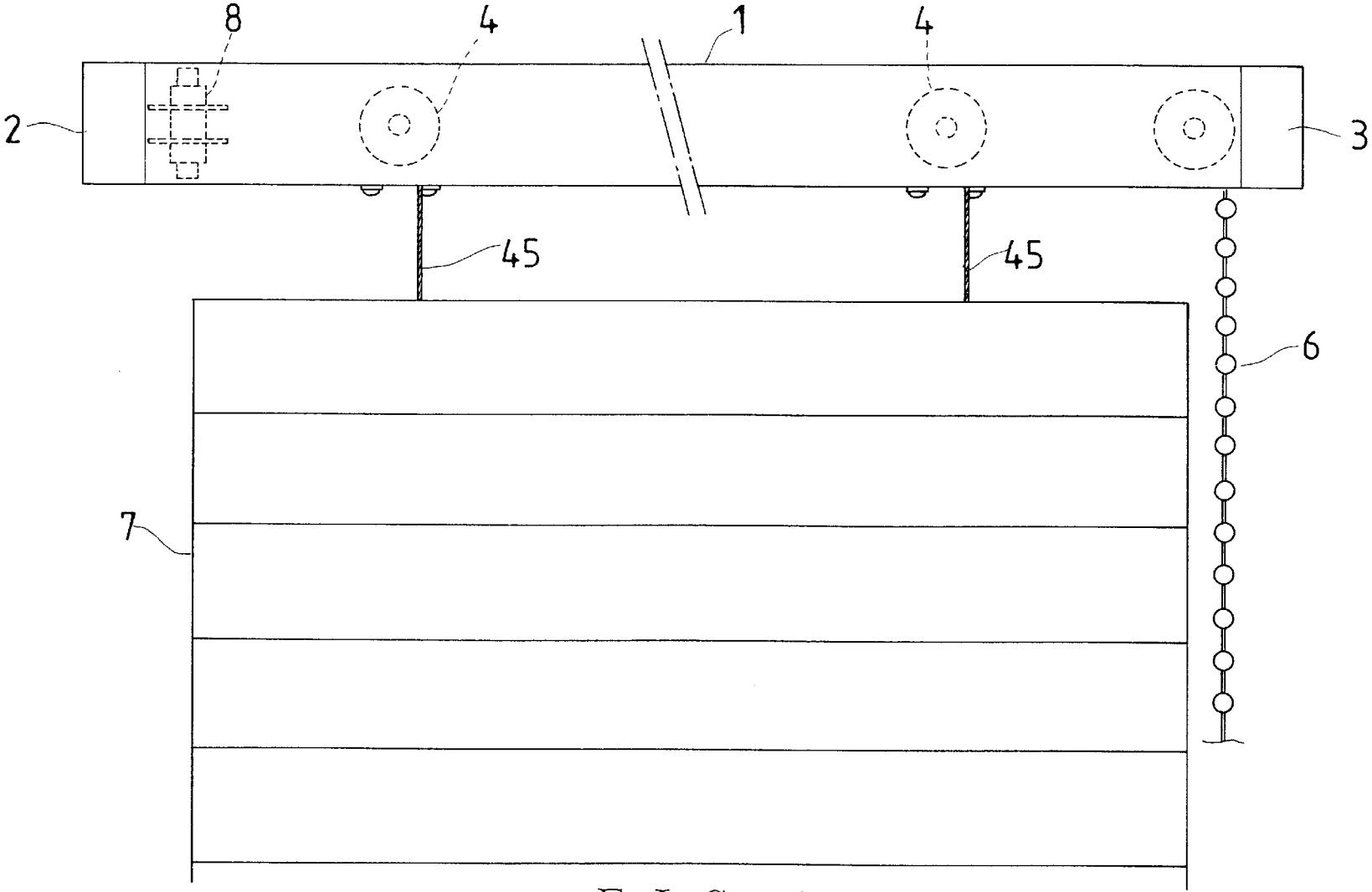
FIG. 5 is a plan view of the raising device with a blind according to the present invention.
Figure 6:
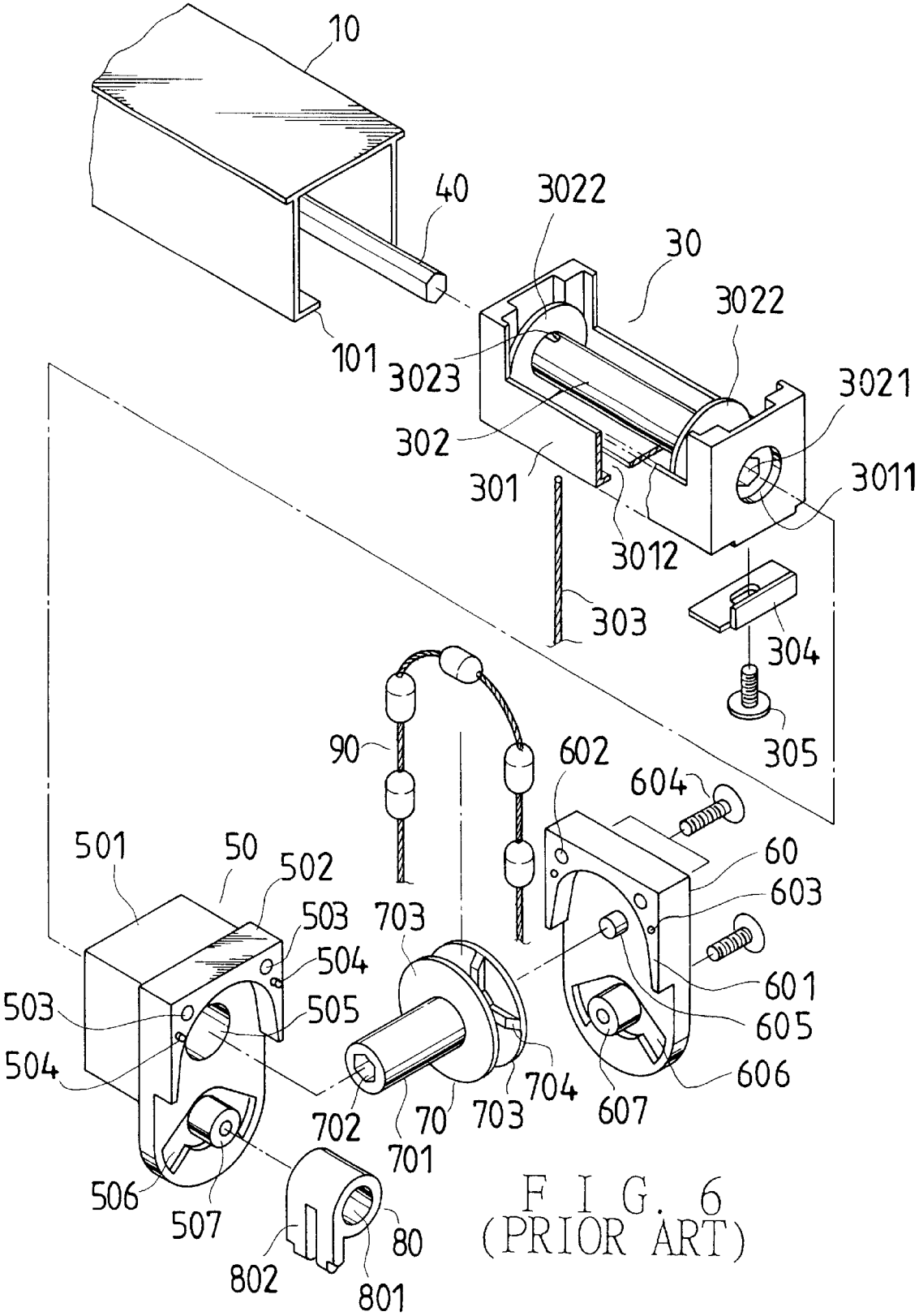
FIG. 6 (PRIOR ART)
FIG. 6 is an exploded perspective view of the conventional raising device for a Venetian blind in the Background.

The turning elements 4 of the intermediate winding members each includes a central reel part 41, two pairs of opposing disk portions 42, which are each connected to one end of the central reel part 41, and cylindrical protrusions 44 sticking out from the centers of the outward facing surfaces of the disk portions 42; each pair of the disk portions 42 is formed with several radially spaced engaging bars 43 on the inner sides; the engaging bars 43 each has a slope 431, which faces outward. The intermediate supports 5 each has a bottom 53, and a front, and a rear walls 51, and 52 sticking up from the edges of the bottom 53; the bottom 53 has a through hole 531; the font and the rear walls 51 and 52 each have a round pivotal hole 511 and 521. The intermediate turning elements 4 are connected to a respective one of the intermediate supports 5 with the cylindrical protrusions 44 being passed into the round pivotal holes 511 and 521 such that the turning elements 4 can be turned in the intermediate supports 5. The intermediate winding members consisting of the turning elements 4 and the intermediate supports 5 are passed into the receiving room of the stationary support element 1, and secured in position with a desired space in between; fixing elements 54 are provided to fix the interposed supports 5 in position that are connected to holding parts 11 of the stationary support element 1 by means of screws 55. Referring to FIGS. 3 and 4, connecting strings 45 are connected to the central reel parts 41 of the intermediate turning elements 4 and the lowermost one of the slats of the Venetian blind.

The third turning element has the same shape as the intermediate turning elements 4, i.e. it has a central reel part, two pairs of opposing disk portions, radially spaced engaging bars, and outward sticking cylindrical parts, and is turnably received in the right support 3, which includes a top 31, a front wall 32 having a round pivotal hole 321, and a rear wall 33 having a round pivotal hole 331; the outward sticking cylindrical parts are each fitted into one of the round pivotal holes 321 and 331. The right support 3 is connected to the right end of the stationary support element 1 with the bottoms of both the front wall 32 and the rear wall 33 being supported on the holding parts 11 of the stationary support element 1.

The first turning element 8 includes two opposing disk portions 82, central rod parts 81 sticking out from the centers of two outer sides of the disk portions 82, and cylindrical protrusions 84, which are thinner than the central rod parts 81, and stick out from the outer ends of the central rod parts 81. The opposing disk portions 82 are also formed with radially spaced engaging bars 83 on the inner sides; the engaging bars 83 each has an outward facing slope 831. The first turning element 8 is received in the left support 2; the left support 2 includes a receiving room 21, which is defined by a top 22 having a round pivotal hole 221, a bottom 23 having a round pivotal hole 231 and both a front and a rear walls (not numbered); the cylindrical protrusions 84 are each passed into one of the round pivotal holes 221 and 231, and the left support 2 is connected to the left end of the stationary support element 1 as shown in FIG. 2 such that the first turning element 8 can be turned with the cylindrical protrusions 84 being upright, and with the disk portions 82 being horizontal.

The lift cord 6 has beads 61 connected thereto in a spaced manner. Referring to FIGS. 2 and 3, the lift cord 6 is passed onto between the disk portions 82 of the first turning element 8 from the middle part, and onto between each pair of the opposing disk portions 42 of the intermediate turning elements 4, and the third turning element from the other parts with the two end portions thereof hanging on the third turning element, and with the beads 61 separably engaging the engaging bars 43 and 83 of all of the turning elements.

Thus, the bind can be lowered and raised easily by means of pulling the end portions of the lift cord 6 downwards; the pulling of the lift cord 6 makes the beads 61 to move so as to cause all tile turning elements to turn due to the engagement of the beads 61 with the engaging bars 43 and 83. The blind will be placed in position without possibility of being lowered by the gravity when the user releases his hold of the lift cord 6 after the pulling action because the engagement of the beads 61 with the engaging bars 83 of the first turning element 8.

From the above description, it can be easily seen that the raising device for a Venetian blind in the present invention has fever parts, and less complicated structure than the convention one, and the winding members are also less complicated than the corresponding parts of the conventional one, therefore the manufacturing cost can be reduced.

What is claimed is:

1. A raising device for a Venetian blind, comprising a stationary support element fitted to an upper side of a window;

a first turning element consisting of two opposing disk portions, and two cylindrical protrusions each sticking out from a center of one of two outer sides of said disk portions; said disk portions being provided with radially spaced engaging bars on an inner side; said first turning element being turnably fitted to a first end of said stationary support element from said cylindrical protrusions thereof with said disk portions being horizontal;

a plurality of second turning elements and a third turning element; said second and said third turning elements each consisting of a central reel part, and two pairs of opposing disk portions connected to two ends of said central part; each pairs of said disk portions being provided with radially spaced engaging bars on an inner side thereof; said second and said third turning elements being each provided with cylindrical protrusions on centers of outer sides of said disk portions thereof; said second turning elements being turnably fitted to intermediate parts of said stationary support element with said disk portions being positioned upright; said central reel parts of said second turning elements being each connected to an upper end of a respective connecting string connected to a lowermost one of slats of a blind at a lower end; said third turning element being turnably fitted to other end of said stationary support element with said disk portions thereof being positioned upright;

a lift cord having a plurality of beads connected thereto in a spaced manner; said lift cord being passed onto between said disk portions of said first turning element from a middle part, and onto between each pair of said opposing disk portions of said second and said third turning elements from two other parts adjacent to said middle part thereof with two end portions hanging on said third turning element, and with said beads separably engaging said radial engaging bars of said turning elements;

whereby said blind can be lowered and raised by pulling said hanging end portions of said lift cord downwards; said downward pulling on said lift cord making said turning elements turn due to said engagement of said beads with said engaging bars.

* * * * *